US007595626B1

(12) United States Patent
Groe

(10) Patent No.: US 7,595,626 B1
(45) Date of Patent: Sep. 29, 2009

(54) SYSTEM FOR MATCHED AND ISOLATED REFERENCES

(75) Inventor: John B. Groe, Poway, CA (US)

(73) Assignee: Sequoia Communications, San Diego, CA (US)

( * ) Notice: Subject to any disclaimer, the term of this patent is extended or adjusted under 35 U.S.C. 154(b) by 391 days.

(21) Appl. No.: 11/418,839

(22) Filed: May 5, 2006

Related U.S. Application Data

(60) Provisional application No. 60/677,912, filed on May 5, 2005.

(51) Int. Cl.
*G05F 3/16* (2006.01)

(52) U.S. Cl. ..... 323/316; 323/314; 327/539

(58) Field of Classification Search ..... 323/312–316; 327/538, 539, 540; 341/144; 365/189.09
See application file for complete search history.

(56) References Cited

U.S. PATENT DOCUMENTS 4,263,560 A 4/1981 Ricker
4,430,627 A 2/1984 Machida
4,769,588 A 9/1988 Panther
4,816,772 A 3/1989 Klotz
4,926,135 A 5/1990 Voorman
4,965,531 A 10/1990 Riley
5,006,818 A 4/1991 Koyama et al.
5,015,968 A 5/1991 Podell et al.
5,030,923 A 7/1991 Arai
5,289,136 A 2/1994 DeVeirman et al.
5,331,292 A 7/1994 Worden et al.
5,399,990 A 3/1995 Miyake
5,491,450 A 2/1996 Helms et al.
5,508,660 A 4/1996 Gersbach et al.
5,548,594 A 8/1996 Nakamura
5,561,385 A 10/1996 Choi
5,581,216 A 12/1996 Ruetz
5,625,325 A 4/1997 Rotzoll et al.
5,631,587 A 5/1997 Co et al.
5,648,744 A 7/1997 Prakash et al.
5,677,646 A 10/1997 Entrikin
5,739,730 A 4/1998 Rotzoll
5,767,748 A 6/1998 Nakao
5,818,303 A 10/1998 Oishi et al.
5,834,987 A 11/1998 Dent
5,862,465 A 1/1999 Ou
5,878,101 A 3/1999 Aisaka
5,880,631 A 3/1999 Sahota
5,939,922 A 8/1999 Umeda
5,945,855 A 8/1999 Momtaz
5,949,286 A 9/1999 Jones
5,990,740 A 11/1999 Groe
5,994,959 A 11/1999 Ainsworth
5,999,056 A 12/1999 Fong
6,011,437 A 1/2000 Sutardja et al.

(Continued)

*Primary Examiner*—Jessica Han
(74) *Attorney, Agent, or Firm*—Cooley Godward Kronish LLP

(57) ABSTRACT

A reference current generator configured to produce matched and isolated current references is disclosed. The reference current generator includes a primary reference generator operative to produce a first reference current. The reference current generator further includes a duplicate reference generator operative to produce a second reference current. An adjustment circuit coupled to the primary reference generator and the duplicate reference generator is configured such that the first reference current is substantially matched to and isolated from the second reference current.

11 Claims, 4 Drawing Sheets

U.S. PATENT DOCUMENTS 6,018,651 A 1/2000 Bruckert et al.
6,031,425 A 2/2000 Hasegawa
6,044,124 A 3/2000 Monahan et al.
6,052,035 A 4/2000 Nolan et al.
6,057,739 A 5/2000 Crowley et al.
6,060,935 A 5/2000 Shulman
6,091,307 A 7/2000 Nelson
6,100,767 A 8/2000 Sumi
6,114,920 A 9/2000 Moon et al.
6,163,207 A 12/2000 Kattner et al.
6,173,011 B1 1/2001 Rey et al.
6,191,956 B1 2/2001 Foreman
6,204,728 B1 3/2001 Hageraats
6,211,737 B1 4/2001 Fong
6,229,374 B1 5/2001 Tammone, Jr.
6,246,289 B1 6/2001 Pisati et al.
6,255,889 B1 7/2001 Branson
6,259,321 B1 7/2001 Song et al.
6,288,609 B1 9/2001 Brueske et al.
6,298,093 B1 10/2001 Genrich
6,304,201 B1 * 10/2001 Moreland et al. ..... 341/154
6,333,675 B1 12/2001 Saito
6,370,372 B1 4/2002 Molnar et al.
6,392,487 B1 5/2002 Alexanian
6,404,252 B1 6/2002 Wilsch
6,476,660 B1 11/2002 Visocchi et al.
6,515,553 B1 2/2003 Filiol et al.
6,559,717 B1 5/2003 Lynn et al.
6,560,448 B1 5/2003 Baldwin et al.
6,571,083 B1 5/2003 Powell, II et al.
6,577,190 B2 6/2003 Kim
6,583,671 B2 6/2003 Chatwin
6,583,675 B2 6/2003 Gomez
6,639,474 B2 10/2003 Asikainen et al.
6,664,865 B2 12/2003 Groe et al.
6,683,509 B2 1/2004 Albon et al.
6,693,977 B2 2/2004 Katayama et al.
6,703,887 B2 3/2004 Groe
6,707,715 B2 * 3/2004 Michael et al. ..... 365/185.18
6,711,391 B1 3/2004 Walker et al.
6,724,235 B2 4/2004 Costa et al.
6,734,736 B2 5/2004 Gharpurey
6,744,319 B2 6/2004 Kim
6,751,272 B1 6/2004 Burns et al.
6,753,738 B1 6/2004 Baird
6,763,228 B2 7/2004 Prentice et al.
6,774,740 B1 8/2004 Groe
6,777,999 B2 8/2004 Kanou et al.
6,781,425 B2 8/2004 Si
6,795,843 B1 9/2004 Groe
6,798,290 B2 9/2004 Groe et al.
6,801,089 B2 10/2004 Costa et al.
6,845,139 B2 1/2005 Gibbons
6,856,205 B1 2/2005 Groe
6,870,411 B2 3/2005 Shibahara et al.
6,891,357 B2 * 5/2005 Camara et al. ..... 323/316
6,917,719 B2 7/2005 Chadwick
6,940,356 B2 9/2005 McDonald, II et al.
6,943,600 B2 9/2005 Craninckx
6,975,687 B2 12/2005 Jackson et al.
6,985,703 B2 1/2006 Groe et al.
6,990,327 B2 1/2006 Zheng et al.
7,015,647 B2 * 3/2006 Maede et al. ..... 315/169.3
7,016,232 B2 * 3/2006 Lee et al. ..... 365/185.21
7,062,248 B2 6/2006 Kuiri
7,065,334 B1 6/2006 Otaka et al.
7,088,979 B1 8/2006 Shenoy et al.
7,123,102 B2 10/2006 Uozumi et al.
7,142,062 B2 11/2006 Vaananen et al.
7,148,764 B2 12/2006 Kasahara et al.
7,171,170 B2 1/2007 Groe et al.
7,215,215 B2 5/2007 Hirano et al.
2002/0071497 A1 6/2002 Bengtsson et al.
2002/0135428 A1 9/2002 Gomez
2002/0193009 A1 12/2002 Reed
2003/0078016 A1 4/2003 Groe et al.
2003/0092405 A1 5/2003 Groe et al.
2003/0118143 A1 6/2003 Bellaouar et al.
2003/0197564 A1 10/2003 Humphreys et al.
2004/0017852 A1 1/2004 Reedman-White
2004/0051590 A1 3/2004 Perrott et al.
2005/0093631 A1 5/2005 Groe
2005/0099232 A1 5/2005 Groe et al.
2006/0003720 A1 1/2006 Lee et al.

* cited by examiner

SYSTEM FOR MATCHED AND ISOLATED REFERENCES

CROSS-REFERENCE TO RELATED APPLICATIONS

This application claims priority under 35 U.S.C. §119(e) to U.S. provisional application Ser. No. 60/677,912, entitled SYSTEM FOR MATCHED AND ISOLATED REFERENCES, filed May 5, 2005, which is hereby incorporated by reference.

FIELD OF THE INVENTION

Embodiments of the invention relate generally to bias reference circuits and, more particularly, to a system for matched and isolated bias references.

BACKGROUND OF THE INVENTION

Radio receivers and transmitters integrate together low noise amplifiers, mixers, RF oscillators, filters, variable gain amplifiers, and high-power driver amplifiers. Each system operates over a wide dynamic range and requires extensive isolation.

In practice, inadequate isolation due to circuit or layout coupling limits the achievable dynamic range. Circuit coupling can occur through circuits shared by multiple components, such as reference circuits, as these circuits offer only limited isolation. For example, strong signals processed by low noise amplifiers, RF Oscillators, and PA drivers can affect common bias sources. It would therefore be advantageous to have reference circuits that are isolated from other system components.

SUMMARY OF THE INVENTION

In summary, the present invention relates to a system and method for providing matched and isolated references. In one exemplary embodiment, a network is provided wherein multiple bias sources are substantially matched and isolated.

In one aspect the present invention is directed to a reference current generator which includes a primary reference generator operative to produce a first reference current. The reference current generator further includes a duplicate reference generator operative to produce a second reference current. An adjustment circuit coupled to the primary reference generator and the duplicate reference generator is configured such that the first reference current is substantially matched to and isolated from the second reference current.

In another aspect the present invention relates to a method for generating matched current references. The method includes generating a primary reference current in response to a reference voltage. A comparison voltage is produced based upon a comparison of the reference voltage and a mirrored voltage related to the primary reference current. The method further includes adjusting a value of a digital control word in accordance with the comparison voltage. A compensation voltage is provided based upon the digital control word. A duplicate reference current is then adjusted in accordance with the compensation voltage so as to match the duplicate reference current to the primary reference current.

BRIEF DESCRIPTION OF THE DRAWINGS

The foregoing aspects of the embodiments described herein will become more readily apparent by reference to the following detailed description when taken in conjunction with the accompanying drawings wherein.

DETAILED DESCRIPTION OF EMBODIMENTS OF THE INVENTION

Figure 1:
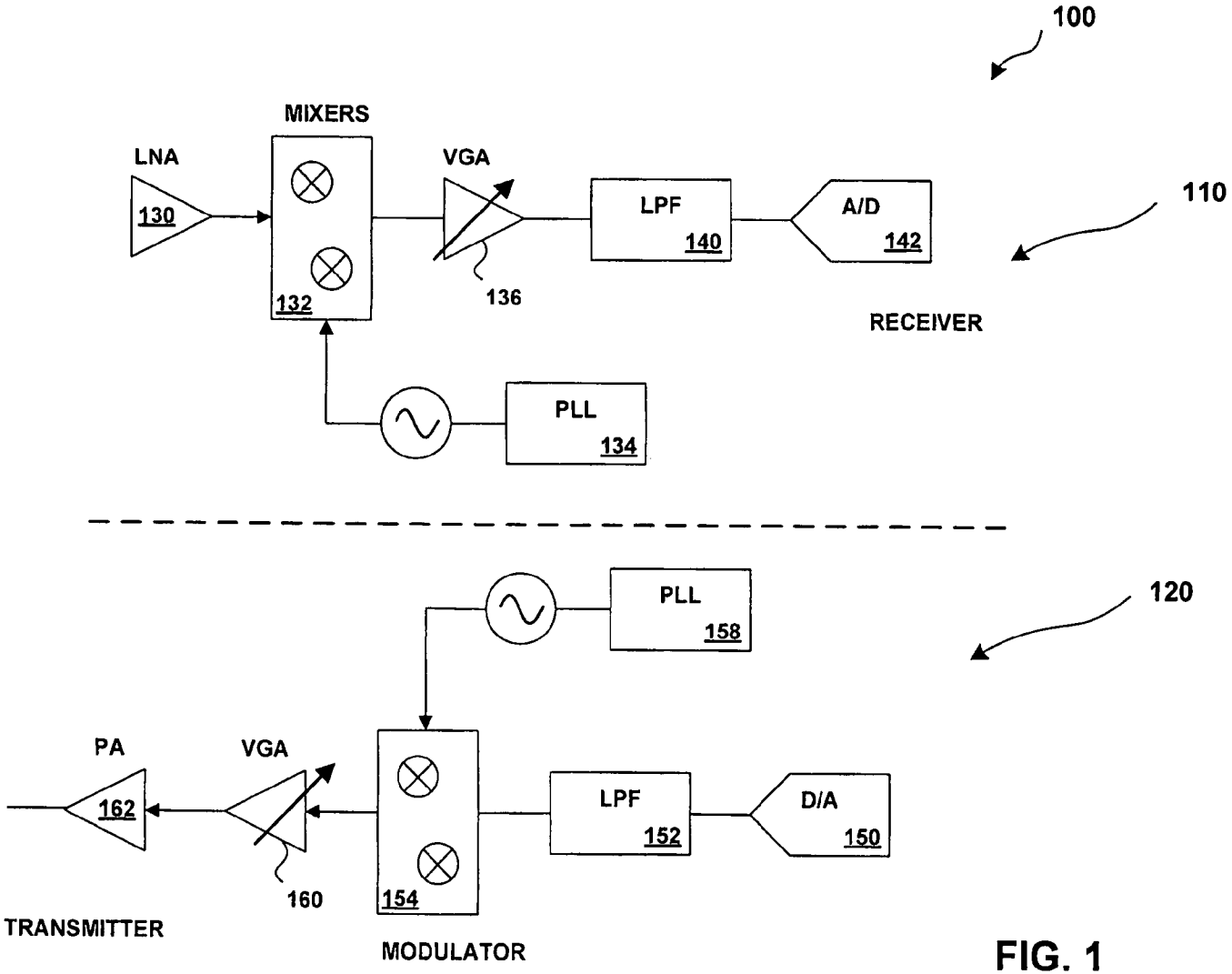
FIG. 1 shows a diagram of a radio transceiver.

FIG. 1 shows a block diagram of a radio transceiver 100 comprising a receiver portion 110 and a transmitter portion 120. The radio receiver 110 operates to receive potentially weak signals and to reject strong interfering signals, covering a wide dynamic range. The radio transmitter 120 forms the transmit signal and generates sufficient power to overcome various wireless impairments. Most communication networks also include power control to minimize interference, while some networks, like CDMA networks, require control over a very wide range.

The receiver 110 comprises a low noise amplifier 130, down-converting mixers 132, frequency synthesizer (PLL and RF oscillator) 134, variable gain amplifiers (VGAs) 136, filters 140, and A/D converters 142. The transmitter 120 includes D/A converters 150, filters 152, a direct I/Q modulator 154, frequency synthesizer 158, RF variable gain amplifiers 160, and PA driver amplifier 162. In general, these circuits receive bias signals from reference circuits (not shown) designed to optimize performance. Accordingly, the reference circuits may emphasize precision, matching, and/or specify a certain temperature behavior. Ideally, the reference circuits resemble current sources with infinite output impedance or voltage sources with zero source impedance.

Figure 2:
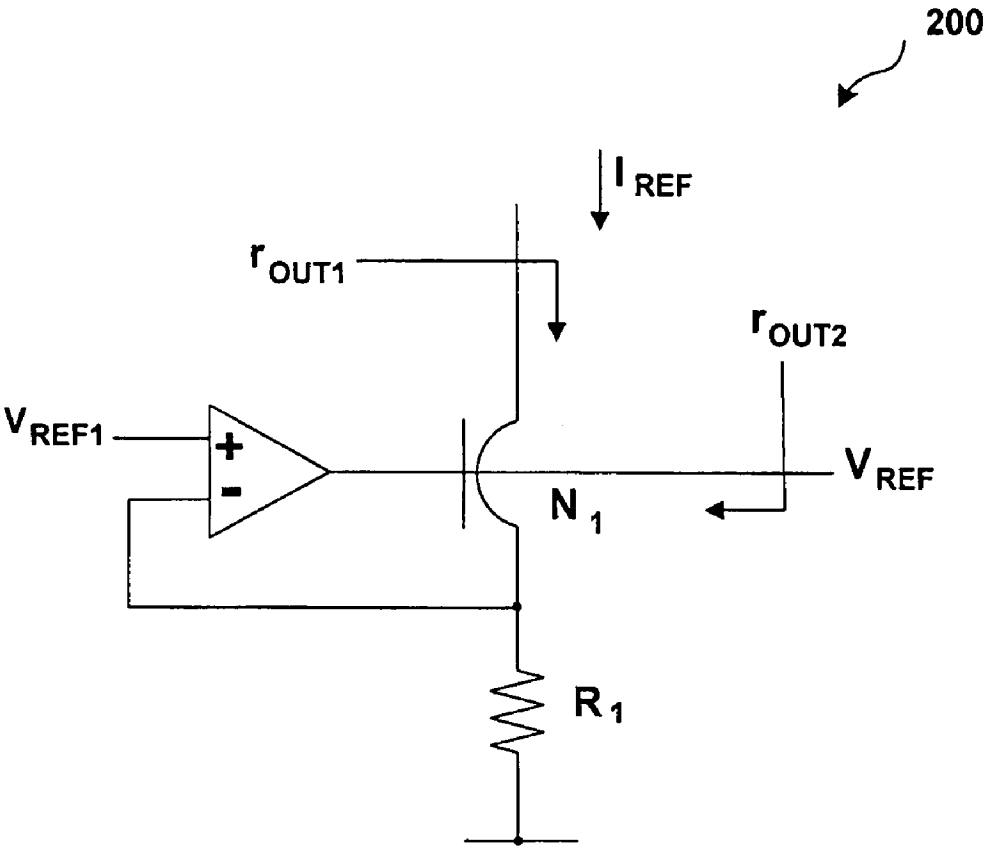
FIG. 2 shows a practical reference circuit.

FIG. 2 shows an exemplary reference circuit 200. As known to those skilled in the art, it is currently impossible to realize ideal reference circuits such as current or voltage sources. The reference circuit of FIG. 2 presents real impedances. It generates a reference current and reference voltage described by;

$$I_{REF} = \frac{V_{REF1}}{R_1}$$

$$V_{REF} = V_{REF1} + V_{gs}$$

where $V_{REF1}$ is a precision voltage source (e.g., such as a bandgap generator), and $V_{gs}$ is the gate-source voltage of the MOS transistor $N_1$. The real impedances presented by each reference are given by;

$$r_{out1} = (1 + g_m R_1) r_o + R_1$$

$$r_{out2} = \frac{r_{op}}{1 + A_{op}}$$

where $r_{out1}$ is the impedance of the current source, $g_m$ is the transconductance and $r_o$ is the output resistance of transistor $N_1$, $r_{out2}$ is the impedance of the voltage reference, and $r_{op}$ is the output resistance and $A_{op}$ the gain of the operational amplifier. Note that the impedance of the current source $r_{out1}$ decreases at high frequencies as $g_m$ falls. Similarly, the gain of the operational amplifier also decreases at high frequencies, increasing $r_{out2}$.

The real impedances of the reference circuits adversely affect the circuit elements driven by them by causing a bias change to occur as these circuit elements draw signal current. Specifically, the bias changes according to:

$$V_{REF} \rightarrow V_{REF} - i_{radio} r_{out2}$$

where $i_{radio}$ represents the signal current drawn from the reference circuit by the radio circuits. This effect consequently couples together radio circuits that share the same reference circuit and thereby limits isolation and dynamic range.

A bandgap circuit generates a precise and temperature stable voltage, making it suitable for generating the $V_{REF}$ voltage. It also means that the reference current $I_{REF}$ shares the same characteristics as resistor $R_1$. This is important since integrated resistors typically show excellent matching but poor accuracy. Fortunately, a variety of circuits can be designed to take advantage of the excellent matching property while they minimize the impact of poor accuracy. However, many radio circuits operating at RF frequencies use inductive elements and therefore require precise bias settings. This is only possible with a precise resistor, which may only be available as an external element. Furthermore, at these frequencies, both $g_m$ and $A_{op}$ fall, making the reference impedances far from ideal.

Isolated references are needed for RF circuits to operate properly. One approach to achieving such isolation involves designing multiple references with separate external resistors. However, this is generally not practical since the result would consume more power and use additional device pins.

Figure 3:
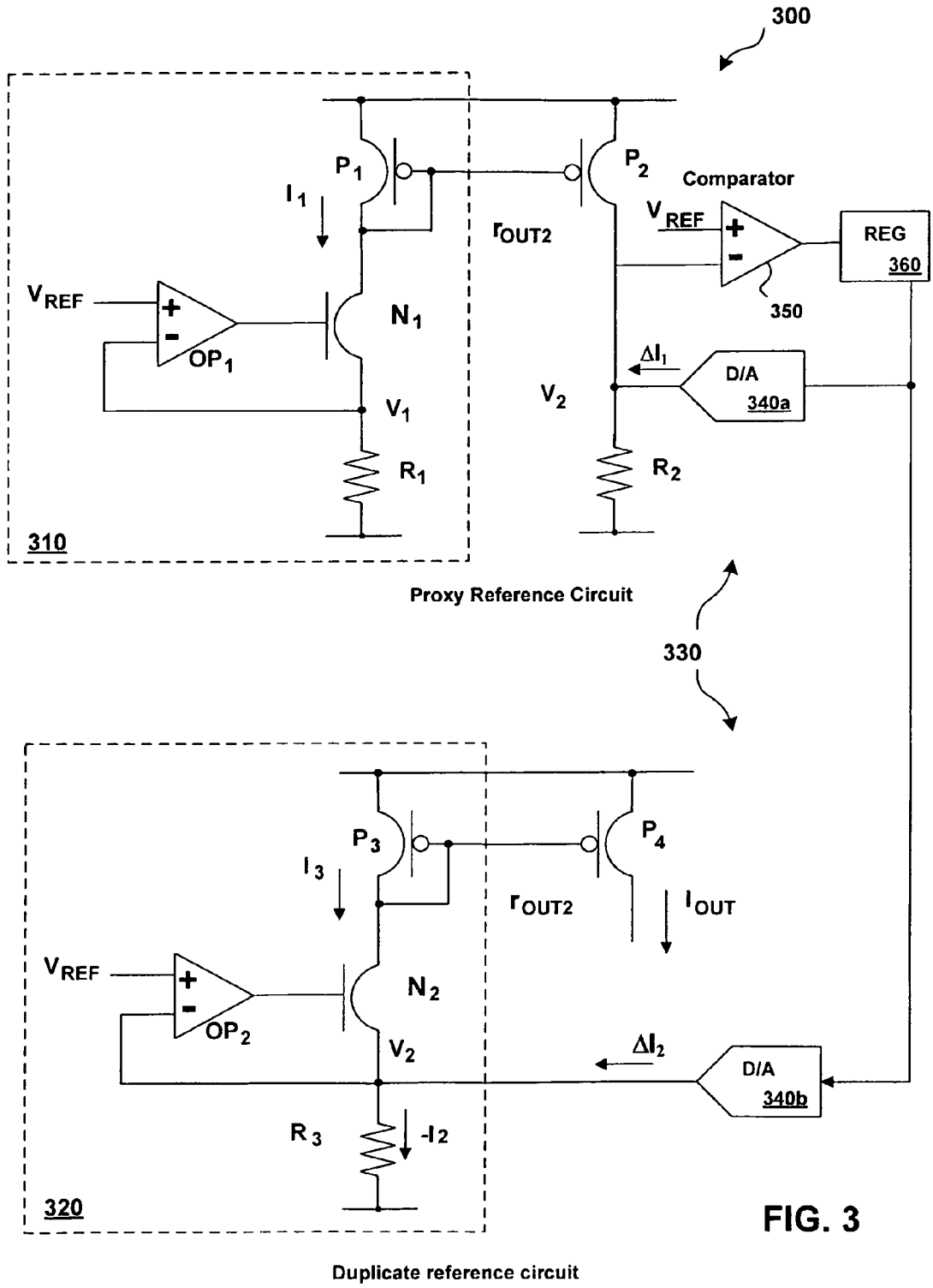
FIG. 3 shows one embodiment of a novel reference network for generating matched and isolated references.

FIG. 3 shows one embodiment of a novel reference network 300 of the present invention that generates matched and isolated bias current sources using at most a single external resistor. The reference network 300 comprises a primary reference circuit 310 and a duplicate reference circuit 320 that are coupled together by an adjustment circuit 330. In one embodiment, the adjustment circuit 330 comprises a pair of D/A converters 340 controlled by the same digital code. The D/A converters 340 adjust the reference network 300 so that the duplicate reference circuit 320 effectively matches the primary reference circuit 310.

The reference network 300 of FIG. 3 operates as follows. Operational amplifier OP1, transistor $N_1$, and resistor $R_1$ establish the primary reference current;

$$I_1 = \frac{V_{REF}}{R_1}$$

Transistors $P_1$ and $P_2$ mirror current $I_1$ to resistor $R_2$, which adds to current $\Delta I_1$ generated by the D/A converter 340*a* to establish the voltage $V_2$ given by;

$$V_2 = (I_1 + \Delta I_1) R_2$$

The comparator 350 senses this voltage, compares it to the reference voltage $V_{REF}$, and adjusts the digital register (REG) 360 that drives the D/A converter 340*a* until voltage $V_2$ equals $V_{REF}$. The current $\Delta I_1$ required to be produced by the D/A converter 340*a* depends on the relationship between resistors $R_1$ and $R_2$. If, $$R_2 = R_1(1+\alpha)$$

then $\Delta I_1$ equals;

$$\Delta I_1 = \frac{V_{REF}}{R_2} - I_1 = \frac{V_{REF}}{R_1(1+\alpha)} - I_1$$

Note that the REG 360 also drives a second D/A converter 340*b*. The D/A converter 340*b* generates an output current $\Delta I_2$ that matches $\Delta I_1$ and feeds the duplicate reference circuit 320. The duplicate reference circuit 320 nominally generates a current $I_2$ described by $$I_2 = \frac{V_{REF}}{R_3}$$

where $R_3$ matches resistor $R_2$. Current $\Delta I_2$ alters the current pulled through transistor $P_3$ such that;

$$I_3 = I_2 - \Delta I_2$$

which gets mirrored to the output. It follows then that;

$$I_{out} = \frac{V_{REF}}{R_3} - \left(\frac{V_{REF}}{R_2} - I_1\right) = I_1$$

which equals the original reference current. In this way a pair of effectively matched and isolated reference current sources $I_{out}$ and $I_1$ are made available for use by external circuits (not shown). Additional matched and isolated current references are possible by replicating operational amplifier $OP_2$, transistors $N_2$, $P_3$-$P_4$, resistor $R_3$, and the D/A converter.

Figure 4:
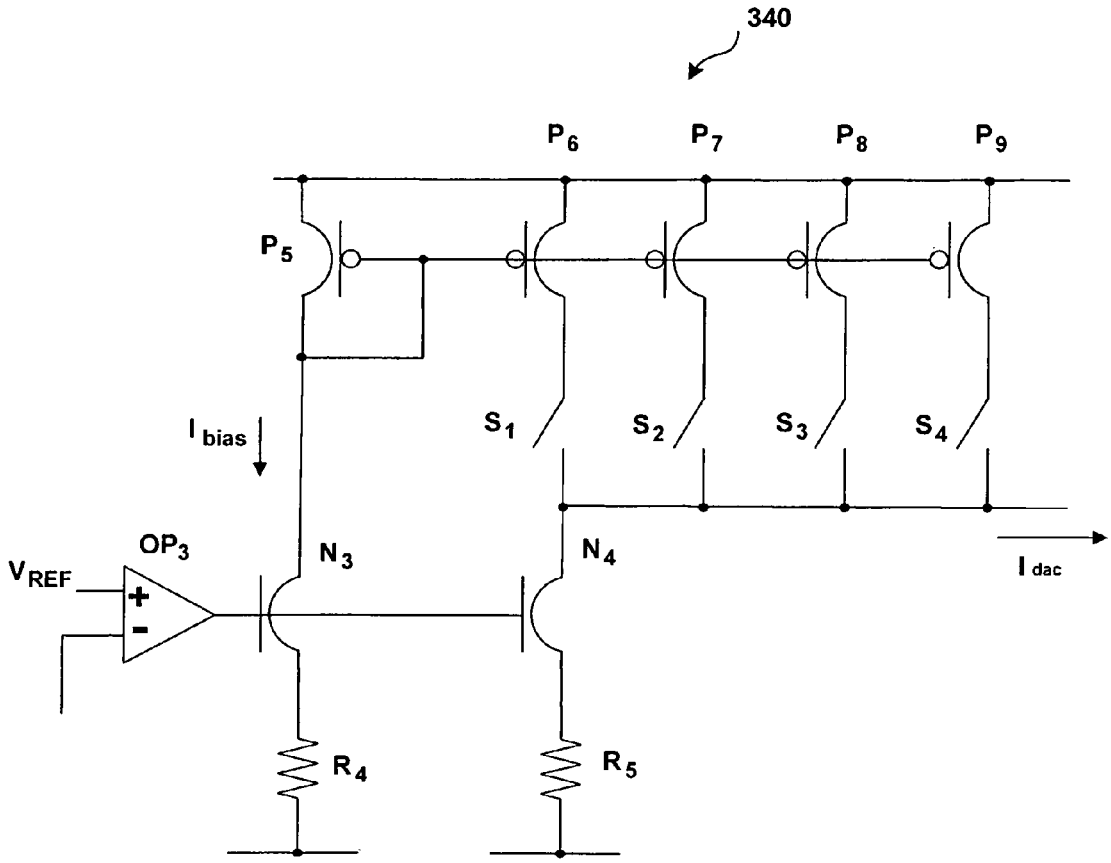
FIG. 4 shows a diagram of one embodiment of a bi-directional D/A converter.

FIG. 4 shows a diagram of an implementation of a bi-directional D/A converter capable of being utilized as the D/A converters 340. As shown, the bi-directional D/A converter of FIG. 4 comprises a current generator and a series of selectable current mirrors. The current generator, consisting of operational amplifier $OP_3$, transistor $N_3$, and resistor $R_4$, produces the current;

$$I_{bias} = \frac{V_{REF}}{R_4}$$

which scales to the output based on transistors $N_4$ plus $P_5$-$P_9$, resistor $R_5$, and switches $S_1$-$S_4$. Accordingly, $$I_{dac} = m\frac{V_{REF}}{R_4} - \frac{V_{REF}}{R_5}$$

where m represents the combined gate width of selected transistors $P_6$-$P_9$ divided by the gate width of transistor $P_5$. Adding transistor $N_4$ and resistor $R_5$ allows for a bi-directional output current $I_{doc}$. In the exemplary embodiment the value of this current with transistors $P_6$-$P_9$ selected is set to be one-half of the maximum scaled PMOS current (equal to $mI_{bias}$) by appropriately sizing transistor $N_4$ and resistor $R_5$. Note that resistors $R_4$-$R_5$ must match sensing resistors $R_2$ and $R_3$ (see FIG. 3) to track any changes.

Referring again to FIG. 3, the only physical link between the primary reference circuit 310 and the duplicate reference circuit 320 is the digital register REG 360. The resulting digital signals possess extensive isolation, which means they are capable of tolerating very large coupling factors—even from very strong signals such as a power amplifier (PA) driver signal. The network 300 is designed to operate properly provided that favorable element matching, which is inherent to integrated circuit technology, is achieved.

Resistor $R_1$ can be realized as an external or integrated element. This allows the reference circuit to generate precise and well-matched bias sources with specific temperature behavior. Note that any temperature sensitivity can be readily designed into the voltage reference ($V_{REF}$).

The novel reference network produces multiple bias references that are both well matched and effectively completely isolated. Thus, embodiments of the reference network are suitable for in any type of circuit such as a receiver, transmitter, amplifier, or any other circuit that may utilize multiple bias references.

The foregoing description, for purposes of explanation, used specific nomenclature to provide a thorough understanding of the invention. However, it will be apparent to one skilled in the art that the specific details are not required in order to practice the invention. In other instances, well-known circuits and devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the following Claims and their equivalents define the scope of the invention.

What is claimed is:

1. A reference current generator comprising:

a primary reference generator operative to produce a first reference current;

a duplicate reference generator operative to produce a second reference current; and an adjustment circuit coupled to the primary reference generator and the duplicate reference generator and configured such that the first reference current is substantially matched to and isolated from the second reference current.

2. The reference current generator of claim 1 wherein the adjustment circuit includes a first digital to analog converter connected to the primary reference generator, a second digital to analog converter connected to the duplicate reference generator, and a digital register wherein the first digital to analog converter and the second digital to analog converter are responsive to a digital code contained within the digital register.

3. The reference current generator of claim 2 wherein the adjustment circuit includes a comparator having an input connected to the primary reference generator and an output which adjusts the digital code contained within the digital register.

4. The reference current generator of claim 1 wherein the primary reference generator includes a comparator responsive to a reference voltage and a current mirror having an output node connected to the adjustment circuit.

5. The reference current generator of claim 4 wherein the duplicate reference generator includes a duplicate comparator responsive to the reference voltage and a duplicate current mirror responsive to an output of the duplicate comparator.

6. The reference current generator of claim 1 wherein the adjustment circuit includes a first bi-directional digital to analog converter connected to the primary reference generator, the first bi-directional digital to analog converter including a current source, a plurality of selectable current mirrors, and an output transistor switchably connected to the plurality of selectable current mirrors.

7. A method for generating matched current references, comprising:

generating a primary reference current in response to a reference voltage;

producing a comparison voltage based upon a comparison of the reference voltage and a mirrored voltage related to the primary reference current;

adjusting a value of a digital control word in accordance with the comparison voltage;

providing a compensation voltage based upon the digital control word; and adjusting a duplicate reference current in accordance with the compensation voltage so as to match the duplicate reference current to the primary reference current.

8. The method of claim 7 wherein the adjusting a duplicate reference current includes comparing the compensation voltage to the reference voltage.

9. A reference current generator apparatus comprising:

a primary reference generator circuit disposed to produce a first reference current;

a duplicate reference generator circuit disposed to produce a second reference current based on the first reference current; and an adjustment circuit coupled to the primary reference generator and the duplicate reference generator to isolate and digitally match the primary reference generator and duplicate reference generator, said digital adjustment circuit including:

a register;

a primary mirror transistor disposed to mirror a current in the primary reference generator;

an adjustment circuit resistor coupled to the primary mirror transistor;

a comparator circuit coupled to the primary circuit mirror transistor and an input of the register;

a first digital to analog converter coupled to an output of the register and the adjustment circuit resistor; and a second digital to analog converter coupled to the output of the register and the duplicate reference generator.

10. The apparatus of claim 9 wherein the first and second digital to analog converters comprise bi-directional digital to analog converters.

11. The apparatus of claim 10 wherein the bi-direction digital to analog converters comprise:

a current generator; and a plurality of selectable current mirrors.

* * * * *

US007595626C1

(12) EX PARTE REEXAMINATION CERTIFICATE (8320th)

United States Patent

Groe

(10) Number: US 7,595,626 C1

(45) Certificate Issued: Jun. 7, 2011

(54) SYSTEM FOR MATCHED AND ISOLATED REFERENCES

(75) Inventor: John B. Groe, Poway, CA (US)

(73) Assignee: Quintic Holdings, Santa Clara, CA (US)

Reexamination Request:
No. 90/009,706, Mar. 19, 2010

Reexamination Certificate for:

| | |
|---|---|
| Patent No.: | **7,595,626** |
| Issued: | **Sep. 29, 2009** |
| Appl. No.: | **11/418,839** |
| Filed: | **May 5, 2006** |

Related U.S. Application Data

(60) Provisional application No. 60/677,912, filed on May 5, 2005.

(51) Int. Cl.
*G05F 3/16* (2006.01)

(52) U.S. Cl. ..... 323/316; 323/314; 327/539

(58) Field of Classification Search ..... None
See application file for complete search history.

(56) References Cited

U.S. PATENT DOCUMENTS

| | | | | |
|---|---|---|---|---|
| 6,304,201 | B1 | 10/2001 | Moreland et al. | 341/154 |
| 6,891,357 | B2 | 5/2005 | Camara et al. | 323/316 |
| 6,946,898 | B1 | 9/2005 | Kerth et al. | 327/530 |

*Primary Examiner*—John Heyman

(57) ABSTRACT

A reference current generator configured to produce matched and isolated current references is disclosed. The reference current generator includes a primary reference generator operative to produce a first reference current. The reference current generator further includes a duplicate reference generator operative to produce a second reference current. An adjustment circuit coupled to the primary reference generator and the duplicate reference generator is configured such that the first reference current is substantially matched to and isolated from the second reference current.

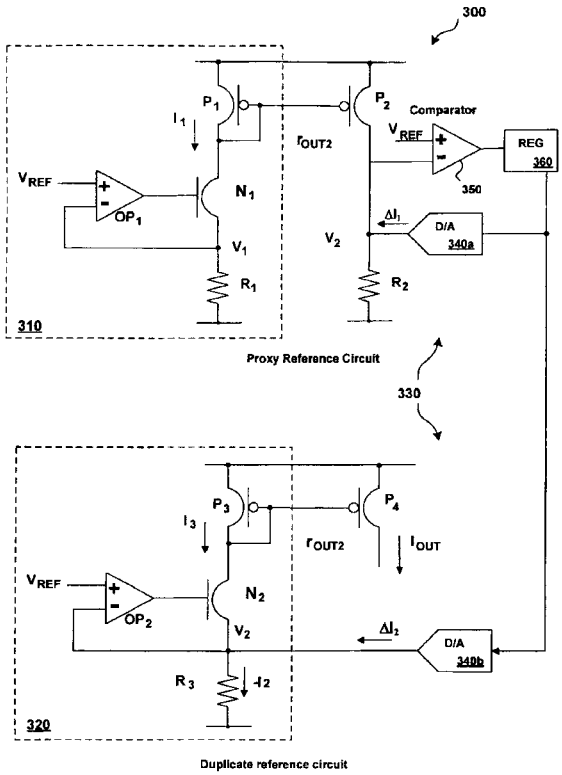

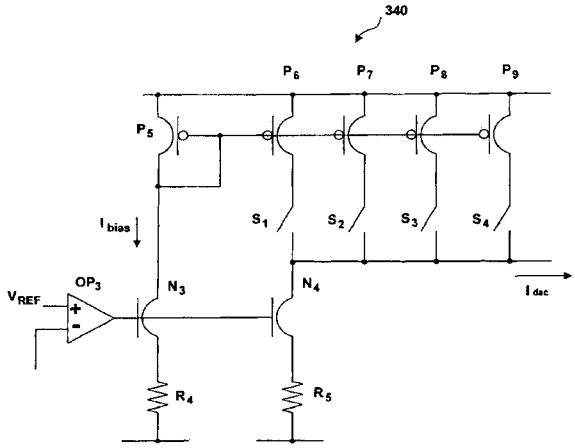

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 7, 8 and 10 are cancelled.

Claims 1, 6, 9 and 11 are determined to be patentable as amended.

Claims 2-5, dependent on an amended claim, are determined to be patentable.

1. A reference current generator comprising:

a primary reference generator operative to produce a first reference current;

a duplicate reference generator operative to produce a second reference current; and an adjustment circuit coupled to the primary reference generator and the duplicate reference generator and configured such that the first reference current is substantially matched to and isolated from the second reference current,*wherein the adjustment circuit includes a digital to analog converter connected to the primary reference generator and the digital to analog converter includes a current source and a plurality of selectable current mirrors*.

6. [The reference current generator of claim 1] *A reference current generator comprising:*

*a primary reference generator operative to produce a first reference current;*

*a duplicate reference generator operative to produce a second reference current; and*

*an adjustment circuit coupled to the primary reference generator and the duplicate reference generator and configured such that the first reference current is substantially matched to and isolated from the second reference current,* wherein the adjustment circuit includes a first bi-directional digital to analog converter connected to the primary reference generator, the first bi-directional digital to analog converter including a current source, a plurality of selectable current mirrors, and an output transistor switchably connected to the plurality of selectable current mirrors.

9. A reference current generator apparatus comprising:

a primary reference generator circuit disposed to produce a first reference current;

a duplicate reference generator circuit disposed to produce a second reference current based on the first reference current; and an adjustment circuit coupled to the primary reference generator and the duplicate reference generator to isolate and digitally match the primary reference generator and duplicate reference generator, said digital adjustment circuit including:

a register;

a primary mirror transistor disposed to mirror a current in the primary reference generator;

an adjustment circuit resistor coupled to the primary mirror transistor;

a comparator circuit coupled to the primary circuit mirror transistor and an input of the register;

a first digital to analog converter coupled to an output of the register and the adjustment circuit resistor; and a second digital to analog converter coupled to the output of the register and the duplicate reference generator*;*

*wherein the first and second digital to analog converters comprise:*

*a current generator; and*

*a plurality of selectable current mirrors*.

11. [The apparatus of claim 10 wherein the bi-direction digital to analog converters comprise] *A reference current generator apparatus comprising:*

*a primary reference generator circuit disposed to produce a first reference current;*

*a duplicate reference generator circuit disposed to produce a second reference current based on the first reference current; and*

*an adjustment circuit coupled to the primary reference generator and the duplicate reference generator to isolate and digitally match the primary reference generator and duplicate reference generator, said digital adjustment circuit including:*

*a register;*

*a primary mirror transistor disposed to mirror a current in the primary reference generator;*

*an adjustment circuit resistor coupled to the primary mirror transistor;*

*a comparator circuit coupled to the primary circuit mirror transistor and an input of the register;*

*a first digital to analog converter coupled to an output of the register and the adjustment circuit resistor; and*

*a second digital to analog converter coupled to the output of the register and the duplicate reference generator,*

*wherein the first and second digital to analog converters comprise bi-directional digital to analog converters, and*

*wherein the bi-direction digital to analog converters comprise*:

a current generator; and a plurality of selectable current mirrors.

* * * * *